US006283084B1

(12) United States Patent
Nagai et al.

(10) Patent No.: US 6,283,084 B1
(45) Date of Patent: Sep. 4, 2001

(54) FOUR-STROKE CYCLE INTERNAL COMBUSTION ENGINE

(75) Inventors: Noboru Nagai, Hachioji; Yumin Liu, Fussa; Tsuneo Araki, Nishitama-gun, all of (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/551,579

(22) Filed: Apr. 18, 2000

(30) Foreign Application Priority Data

Apr. 19, 1999 (JP) ..... 11-111188

(51) Int. Cl.[7] ..... F01M 1/00
(52) U.S. Cl. ..... 123/196 R; 184/6.2
(58) Field of Search ..... 123/196 R; 184/6.2, 184/6.5, 6.9, 11.4

(56) References Cited

U.S. PATENT DOCUMENTS 5,243,937 9/1993 Imagawa .
5,960,764 10/1999 Araki .

FOREIGN PATENT DOCUMENTS 10246106A 9/1998 (JP) .
11-2111 * 1/1999 (JP) .

* cited by examiner

*Primary Examiner*—Noah P. Kamen
(74) *Attorney, Agent, or Firm*—Jacobson Holman, PLLC

(57) ABSTRACT

A four-stroke cycle internal combustion engine comprises a connecting rod which has an oil dipper at a big-end thereof, a crankcase, a partition wall which surrounds the connecting rod to provide a separation between the crankcase and an oil reservoir and an outer wall which is outward of and surrounds the partition wall and is connected to the partition wall at upper ends thereof so as to define the oil reservoir below the crankcase. A slit is formed in the partition wall below the connecting rod to allow the oil dipper to protrude into and be withdrawn from the oil reservoir to splash oil in the oil reservoir for lubrication by the oil dipper through a swinging motion of the connecting rod. The depth of the oil reservoir is shallower at least in a part of an outer edge area thereof than that below the oil dipper so that a tip of the oil dipper reaches the oil level even when the oil flows into the outer edge area of the oil reservoir.

5 Claims, 9 Drawing Sheets

FOUR-STROKE CYCLE INTERNAL COMBUSTION ENGINE

BACKGROUND OF THE INVENTION

The present invention relates to a four-stroke cycle internal combustion engine preferably used for driving a portable working machine such as a portable trimmer, though not limited thereto, and in particular, to a four-stroke cycle internal combustion engine which is lubricated by oil in an oil reservoir provided below a connecting rod, which oil is splashed up by an oil dipper formed on a big-end of the connecting rod.

DESCRIPTION OF THE PRIOR ART

It has been known to use a portable working machine such as a portable trimmer driven by an electric spark ignition type internal combustion engine. Formerly, a two-stroke cycle internal combustion engine was generally used as an internal combustion engine for a portable working machine, but recently, there has been an increasing demand for utilizing a four-stroke cycle internal combustion engine in order to improve the air pollution problem caused by exhaust gas. Such four-stroke cycle internal combustion engine has an oil reservoir (oil pan) below a crankcase, which accommodates oil for lubricating each part of the engine. The oil in the oil reservoir is splashed up causing oil-mist by an oil dipper formed on a big-end of a connecting rod and the oil-mist is supplied to the crankcase, a chamber for a valve gear or the like to lubricate various components.

In the portable working machine, for example, in a portable trimmer, a power transmitting shaft is coupled with a front end of a crankshaft of an internal combustion engine via a centrifugal clutch, and a rotary blade for trimming is coupled with a front end of the power transmitting shaft via a gear box. An operator holds such a portable trimmer by hand and cuts weeds on the ground or trims branches of a tree above the operator's head with the rotary trimming blade driven by the internal combustion engine. Accordingly, the internal combustion engine of the portable working machine is forced, during operation, to assume a horizontal position, or an upside-down position, or some position other than a cylinder-upright position. A substantially U-shaped oil reservoir surrounding both sides and a lower side of the crankcase is disclosed, for example, in Japanese Patent Laid-open Disclosure Nos. Hei 8-260926 and Hei 10-231717. When a four-stroke cycle internal combustion engine takes various positions as described above, this type of oil reservoir allows the oil to be accommodated in oil recess areas located on the side of the crankcase to prevent the oil from flowing into the crankcase or into a cylinder area and thereby to prevent the piston from soaking in the oil or the breather from being clogged up.

However, when the internal combustion engine takes various positions as described above, the oil in the oil reservoir flows into the oil recess areas or other recess areas to prevent the oil from flowing into the crankcase or the like, while at the same time there may occur a condition where the oil dipper cannot reach the oil and thereby no oil mist is supplied to each part of the four-stroke cycle internal combustion engine.

Accordingly, the object of the present invention is to provide a four-stroke cycle internal combustion engine which can be used to drive the portable working machine, that is, which ensures the oil to be splashed up by the oil dipper even under a tilted condition or the like.

SUMMARY OF THE INVENTION

The object of the present invention described above can be achieved by a four-stroke cycle internal combustion engine comprising: a connecting rod, an oil dipper provided at a big-end of the connecting rod; a crankcase; an oil reservoir below the crankcase; a partition wall which surrounds the connecting rod to provide a separation between the crankcase and the oil reservoir; and an outer wall which is outward of and surrounds the partition wall and is connected to the partition wall at upper ends thereof so as to define an oil reservoir below the crankcase; a slit formed in the partition wall below the connecting rod to allow the oil dipper to protrude into and be withdrawn from the oil reservoir to splash oil in the oil reservoir for lubrication by the oil dipper through a swinging motion of the connecting rod; the depth of the oil reservoir being shallower at least in a part of an outer edge area thereof than that below the oil dipper so that a tip of the oil dipper reaches the oil level of the oil reservoir even when the oil flows into the outer edge area of the oil reservoir.

In the present invention, regarding the depth of the oil reservoir along the direction of the center line of the connecting rod, at least a part thereof located on an outer edge area is shallower than that located below the oil dipper. Accordingly, when the four-stroke cycle internal combustion engine is rotated and tilted about an axis intersecting with the crankshaft and thereby the oil flows into the outer edge area of the oil reservoir, the tip of the oil dipper reaches the oil level and the oil is assured to be splashed up by the oil dipper to supply the oil mist to each component in the engine.

DESCRIPTION OF THE PREFERRED EMBODIMENT

Figure 1:
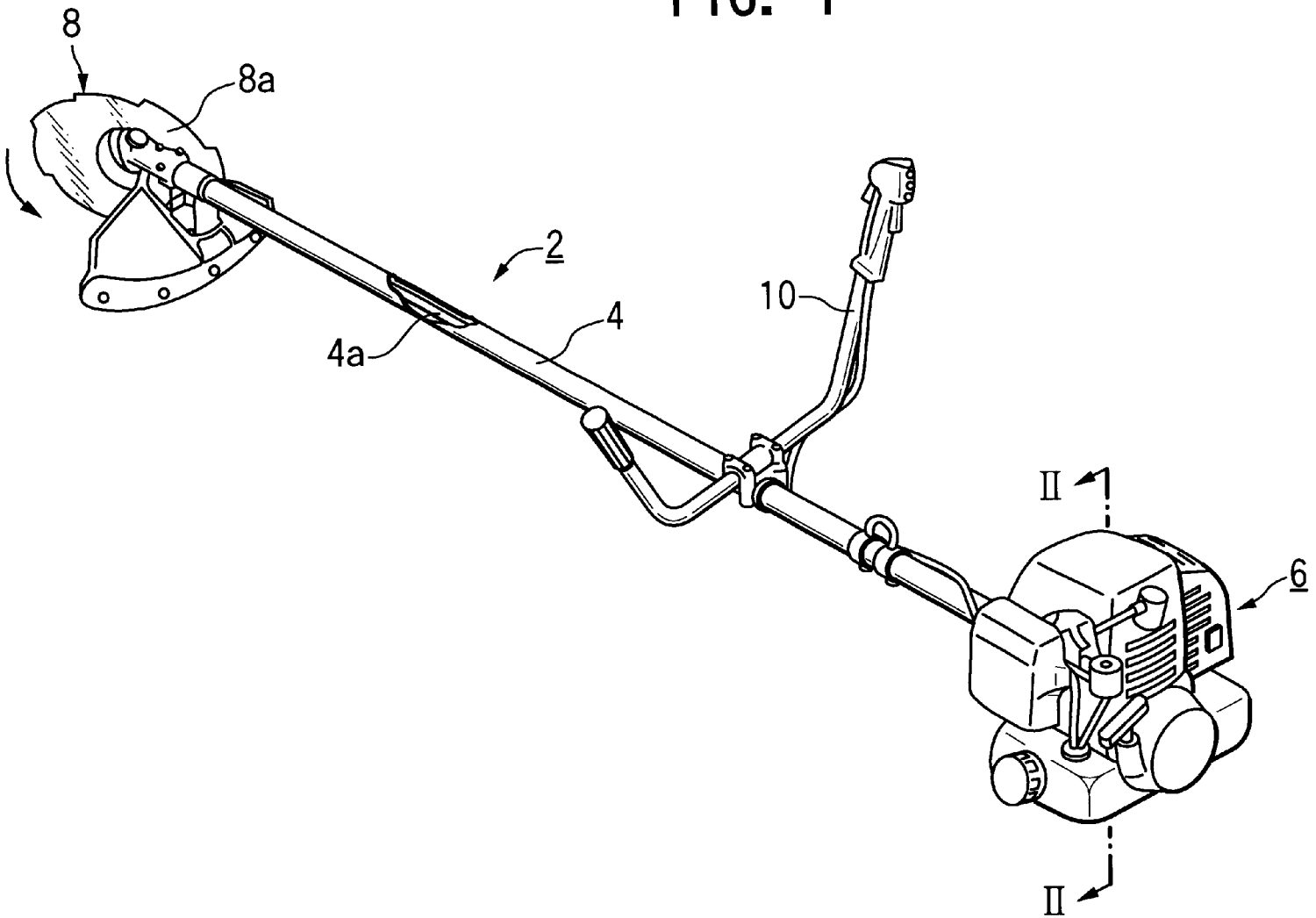
FIG. 1 is an overall perspective view of a portable trimmer.

Referring to the drawings attached herein, embodiments of the present invention shall be described by explaining a portable trimmer as one example of portable working machines.

As shown in FIG. 1, a portable trimmer 2 includes a supporting tube 4 which has a power transmitting shaft 4*a* inserted therein, a four-stroke cycle internal combustion engine 6 at its rear end, and a working section 8 at its front end. The working section 8 is equipped with a cutting blade 8*a* rotatably mounted to cut weeds in a direction indicated by an arrow. A rotational force from the four-stroke cycle internal combustion engine 6 is transmitted via a centrifugal clutch or the like, though not shown, to the power transmitting shaft 4*a* to rotate the cutting blade 8*a*. An operator holds a handle section 10 provided at the middle portion of the supporting tube 4 by both hands to perform a trimming operation.

Figure 2:
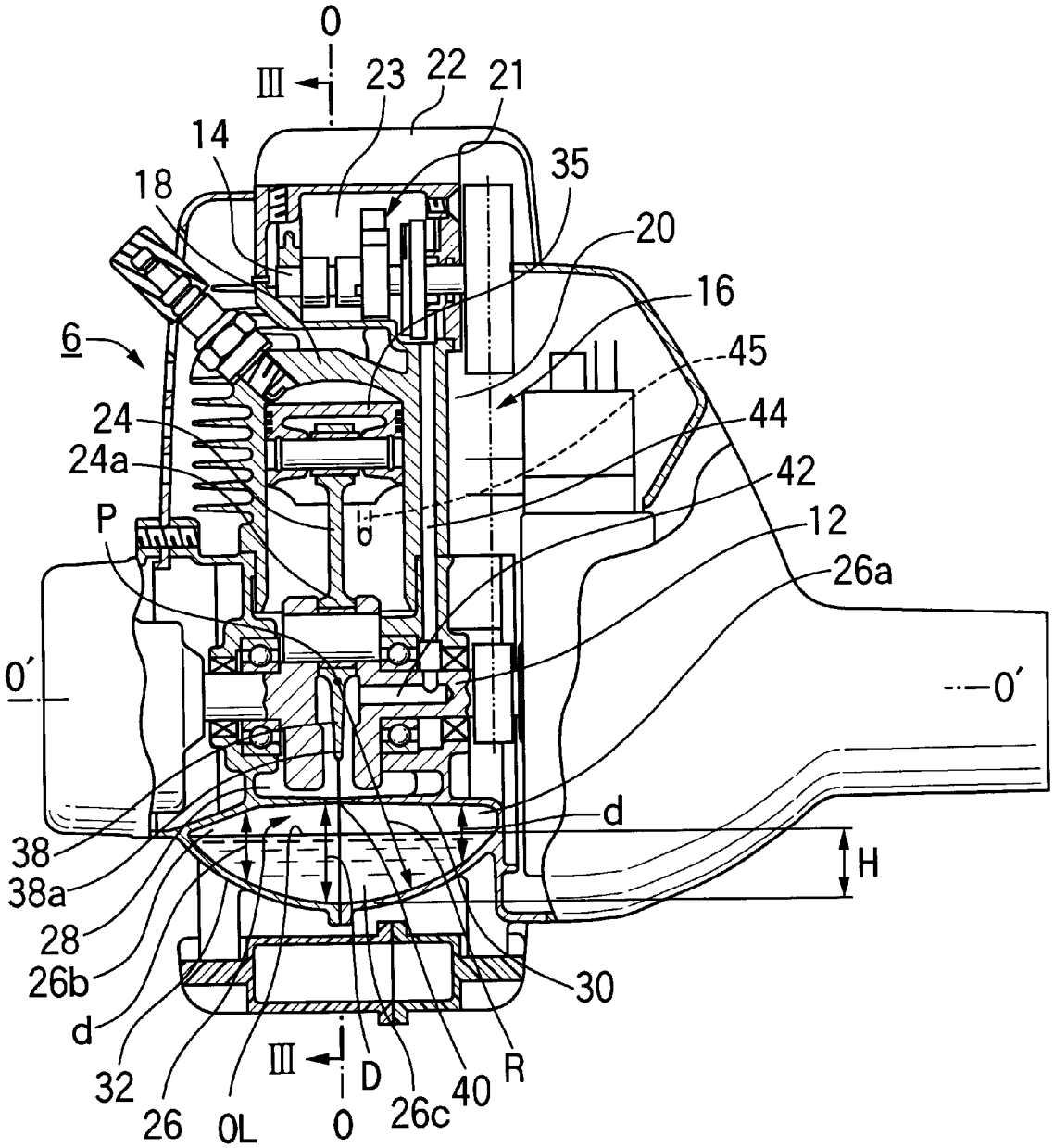
FIG. 2 is a cross-sectional view taken along a line II—II of FIG. 1, illustrating a cylinder's upright position in a four-stroke cycle internal combustion engine in accordance with a first embodiment of the present invention.

The four-stroke cycle internal combustion engine 6 of the first embodiment shown in FIG. 2 is of an air-cooled type and of an OHC type. As can be seen in FIG. 2, the rotation of a crankshaft 12 is transmitted to a camshaft 14 through an appropriate gearing mechanism 16. The gearing mechanism 16 is disposed on the front side of a cylinder block 18 of the four-stroke cycle internal combustion engine 6, that is, on the side toward the cutting blade 8*a* and is accommodated in a gear chamber 20 defined vertically along an upright cylinder block 18. A cam chamber 23 which accommodates a valve drive mechanism 21 and is enclosed by a liquid-tight detachable cover 22 is disposed on the cylinder block 18.

Figure 5A:
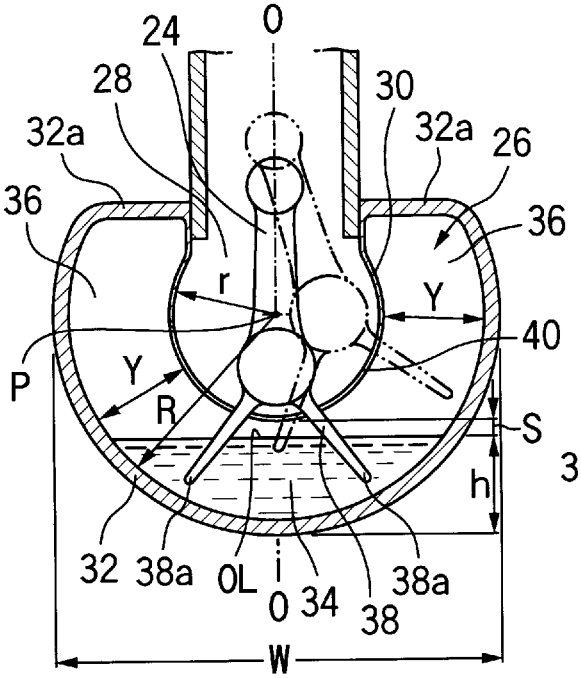
FIG. 5 is a schematic cross-sectional view take along a line III—III of FIG. 2.

As best shown in FIG. 5*a,* the four-stroke cycle internal combustion engine 6 has a partition wall 30 which surrounds a connecting rod 24 on both the left and right sides and the lower side thereof to define a crankcase 28 and provides a separation between the crank case 28 and an oil reservoir 26 disposed therebelow. An outer wall 32 surrounds the partition wall 30 and is connected to the partition wall 30 at the left and right upper ends 32*a,* 32*a* thereof so as to form the oil reservoir 26 on an outer side of the crankcase 28. The oil reservoir 26 includes an oil reserving area 34 disposed below the crankcase 28 and oil recess areas 36, 36 disposed on both sides of the crankcase 28. Each of the oil recess areas 36, 36 has a volume capable of accommodating all oil accommodated in the oil reservoir area 34.

Two oil dippers 38, 38 are formed on a big-end 24*a* of the connecting rod 24 directed downwardly so as to form a V-shape therebetween in order to splash up the oil in the oil reservoir 26 forced by a swinging motion of the connecting rod 24 and to supply the oil mist to the crankcase 28 and to each part of the cam chamber 23. Each of the oil dippers 38, 38 extends straight toward each of the oil recess areas 36, 36 in an obliquely downward direction. In detail, each of the oil dippers 38 extends in the obliquely downward direction so as to be bilaterally symmetrical with respect to a center line O—O of the connecting rod 24 located at top or bottom dead center thereof with an angle of about 45 degrees therefrom toward each of the oil recess areas 36, 36, respectively. Referring again to FIG. 2, each of the oil dippers 38, 38 extends straight in a downward direction along the center line O—O of the connecting rod in the side elevational view.

In addition, a slit 40 is formed in the partition wall 30 for allowing the oil dippers 38, 38 to protrude into and withdraw from the oil reservoir 26 by an up-and-down motion of a piston 35 of the four-stroke cycle internal combustion engine 6 so as to splash up the oil from the oil reservoir 26. The slit 40 is formed to be of minimum size for allowing the oil dipper to pass through without interference therebetween so as to prevent the oil from flowing into the crankcase 28 while the four-stroke cycle internal combustion engine 6 is tilted. As also can be seen in FIG. 2, a first oil mist passage 42 is formed in the crankshaft 12, which extends longitudinally and communicates with the crankcase 28 at one end thereof. A second oil mist passage 44 is formed in the front side portion of the cylinder block 18 which extends vertically and communicates with the other end of the first oil mist passage 42 at a lower end thereof and also communicates with the cam chamber 23 at an upper end thereof. In addition, the cam chamber 23 communicates with the crankcase 28 through a third oil mist passage 45 formed in the cylinder block 18 extending downward, and thereby a circulating channel of the oil mist is defined.

Referring to FIG. 2, the outer wall 32 is formed approximately into an arc defined by a center P located at the center line of the connecting rod 24 or the oil dippers 38, 38 and a radius R. Further, referring to FIG. 5*a,* the outer wall 32 is formed into a substantially arc-like shape defined by the center P and the radius R. That is, the outer wall 32 is formed into a hemisphere or bowl shape about the center P, which surrounds the oil dippers 38, 38 and is curved upwardly. On the other hand, referring to FIG. 2, the partition wall 30 extends horizontally straight below the crankcase 28 in the vertical cross-sectional view including the axial line O'—O' of the crankshaft 12. In the cross-sectional view shown in FIG. 5*a,* the partition wall 30 is drawn as an arc defined by the center P and a radius "r" extending concentrically with the outer wall 32. That is, the partition wall 30 is formed into a cylindrical shape which extends laterally surrounding the crankshaft 12 and is open upwardly. The outer wall 32 is connected to the partition wall 30 at the upper ends 32*a,* 32*a* thereof to form the oil reservoir 26. That is, as shown in FIG. 5, in the cross-section intersecting with the crankshaft 12 at a right angle at a center line of the connecting rod 24, the oil reservoir is formed into a C-shape opening directed upwardly or a semi-ring-shape having a uniform width Y around the connecting rod 24.

Referring to FIG. 2 again, as described above, the oil reservoir 26 is generally formed into a crescent-like shape enclosed by the partition wall 30 horizontally extending substantially straight and the outer wall 32 extending as an arc in the vertical cross-section including the crankshaft axial line O'—O', and thereby a front outer edge area 26*a* and a rear outer edge area 26*b* of the oil reservoir 26 are made narrower than a downside area 26*c* thereof located below the oil dipper 38 or made to be rather flat. That is, a depth "d" of the oil reservoir 26 measured vertically along the longitudinal center line O—O of the connecting rod 24 takes a maximum value D below the dipper 38. The depth "d" decreases gradually with increasing distance from the oil dipper 38 since the outer wall 32 is upwardly inclined toward the oil dipper 38 to raise the bottom up with increasing distance from the oil dipper 38.

Figure 3:
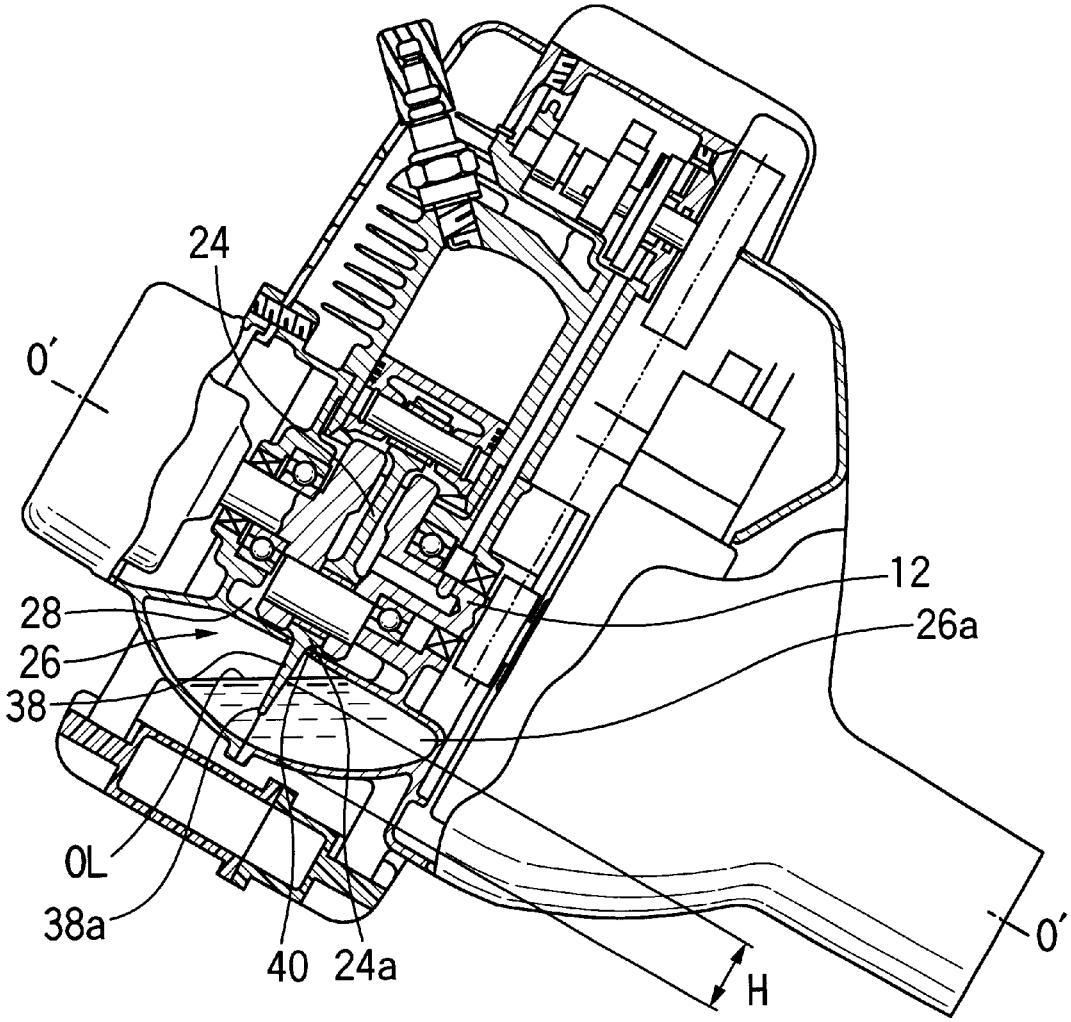
FIG. 3 is a cross-sectional view taken along a line II—II of FIG. 1, illustrating a forwardly tilted position in a four-stroke cycle internal combustion engine in accordance with the first embodiment of the present invention.
Figure 4:
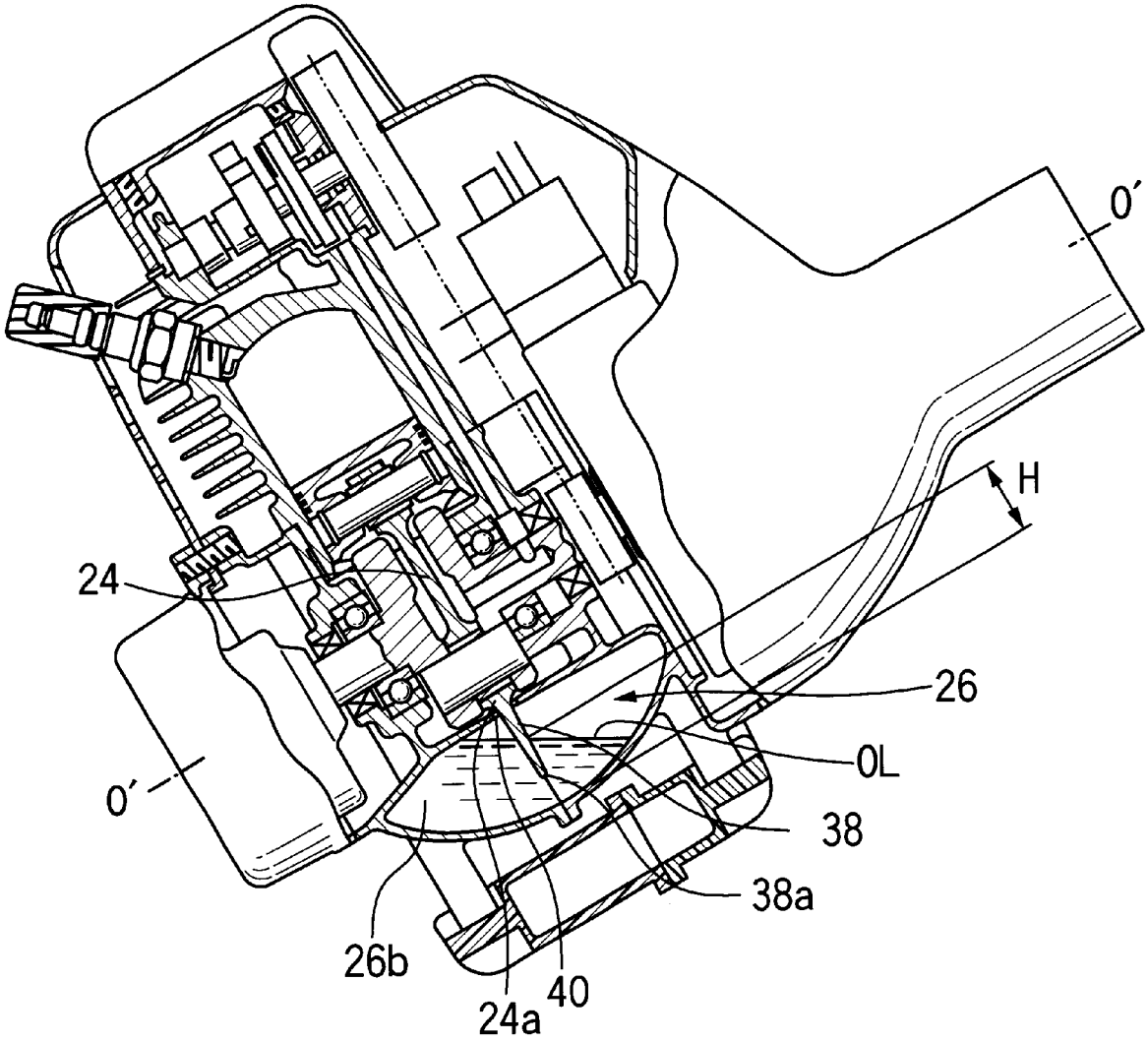
FIG. 4 is a cross-sectional view taken along a line II—II of FIG. 1, illustrating a backwardly tilted position in a four-stroke cycle internal combustion engine in accordance with the first embodiment of the present invention.

Referring to FIGS. 2 and 4, the operation of the first embodiment will hereafter be described. The four-stroke cycle internal combustion engine 6 of the portable trimmer 2 in accordance with the first embodiment is used in various tilted positions when an operator uses the cutting blade 8*a* to cut weeds located at a height less or more than the operator's waist or branches above the operator's head. Among these positions, FIG. 3 illustrates a forwardly tilted position which occurs when the operator uses the cutting blade 8*a* mounted on a front end of the portable trimmer 2 to cut weeds or the like located at a height less than the operator's waist, that is, when the four-stroke cycle internal combustion engine 6 is tilted forward around a lateral line intersecting horizontally with the crankshaft 12.

Further, FIG. 4 illustrates a backwardly tilted position which occurs when the operator uses the cutting blade 8*a* mounted on the front end of the portable trimmer 2 to cut the weeds, branches or the like located at a height more than the operator's waist, that is, when the four-stroke cycle internal combustion engine 6 is tilted backward around the lateral line. As can be seen in FIGS. 3 and 4, the oil in the reservoir 26 flows into the front outer edge area 26*a* (in the case of FIG. 3) or the rear outer edge area 26*b* and is accommodated therein. At that time, the height of an oil level OL just below the oil dipper 38 is approximately a height H in any case, since the front outer edge area 26*a* and the rear outer edge area 26*b* are made narrower, that is, it is approximately the same with the height H of the oil level in case of the upright position shown in FIG. 2. Since especially the outer wall 32 is formed into a sphere or arc shape in the cross-section of FIG. 2, the height H of the oil level OL is kept constant to be approximately the same with that of the cylinder-upright position shown in FIG. 2 even if the four-stroke cycle internal combustion engine 6 is tilted forward or backward, without regard to the magnitude of the tilted angle thereof. Each of the volumes of a front portion and a rear portion of the oil reservoir 26 with respect to the connecting rod center line O—O has a volume capable of accommodating the oil in the oil reservoir 26 when the four-stroke cycle internal combustion engine 6 is in the forwardly tilted position or in the backwardly tilted position.

The oil mist in the crankcase 28 is sent to the cam chamber 23 through the first oil mist passage 42 and the second oil mist passage 44 by positive and negative pressure generated by the up-and-down motion of the piston 35. Surplus oil mist and liquid oil in the cam chamber 23 is returned to the crankcase 28 through the third oil mist passage 45 and then is returned to the oil reservoir 26 through the slit 40.

Figure 5B:
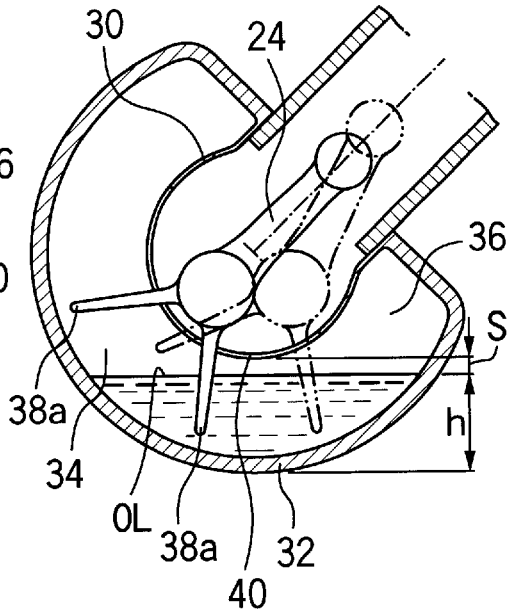
Figure 5C:
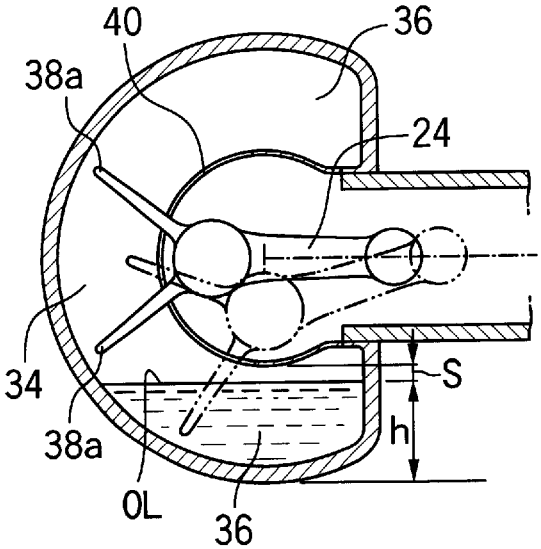

FIG. 5 shows a schematic vertical cross-section intersecting with the crankshaft 12 at a right angle at a position of the connecting rod 24, wherein FIG. 5*a* shows a case where the four-stroke cycle internal combustion engine 6 is in the upright position, FIG. 5*b* shows a case where the four-stroke cycle internal combustion engine 6 is in the laterally tilted position rotated laterally to the right around the crankshaft 12, and FIG. 5*c* show a case where the four-stroke cycle internal combustion engine 6 is in a horizontal position after being rotated further to the right up to a horizontal direction.

The operation of the first embodiment will be described further with reference to FIGS. 5*a* to 5*c*. As the four-stroke cycle. Internal combustion engine 6 is tilted from the upright position shown in FIG. 5*a* to the position tilted toward the right shown in FIG. 5*b* and then further to the horizontal position shown in FIG. 5*c*, the oil accommodated in the oil reserving area 34 gradually flows into the right oil recess area 36. At that time, since the outer wall 32 is formed into a spherical shape, a height "h" of the oil level OL is kept approximately constant and a minimum distance S between the oil level OL and the partition wall 30 is also kept approximately constant irrespective of the position of the four-stroke cycle internal combustion engine 6. Thereby, even if the four-stroke cycle internal combustion engine 6 is in the tilted or even in the horizontal position, at least one of the oil dippers 38, that is, at least one of the oil dippers 38 extending toward the oil reserving area 36 where the oil is accommodated will certainly come in contact with the oil to certainly produce the oil mist.

Figure 6:
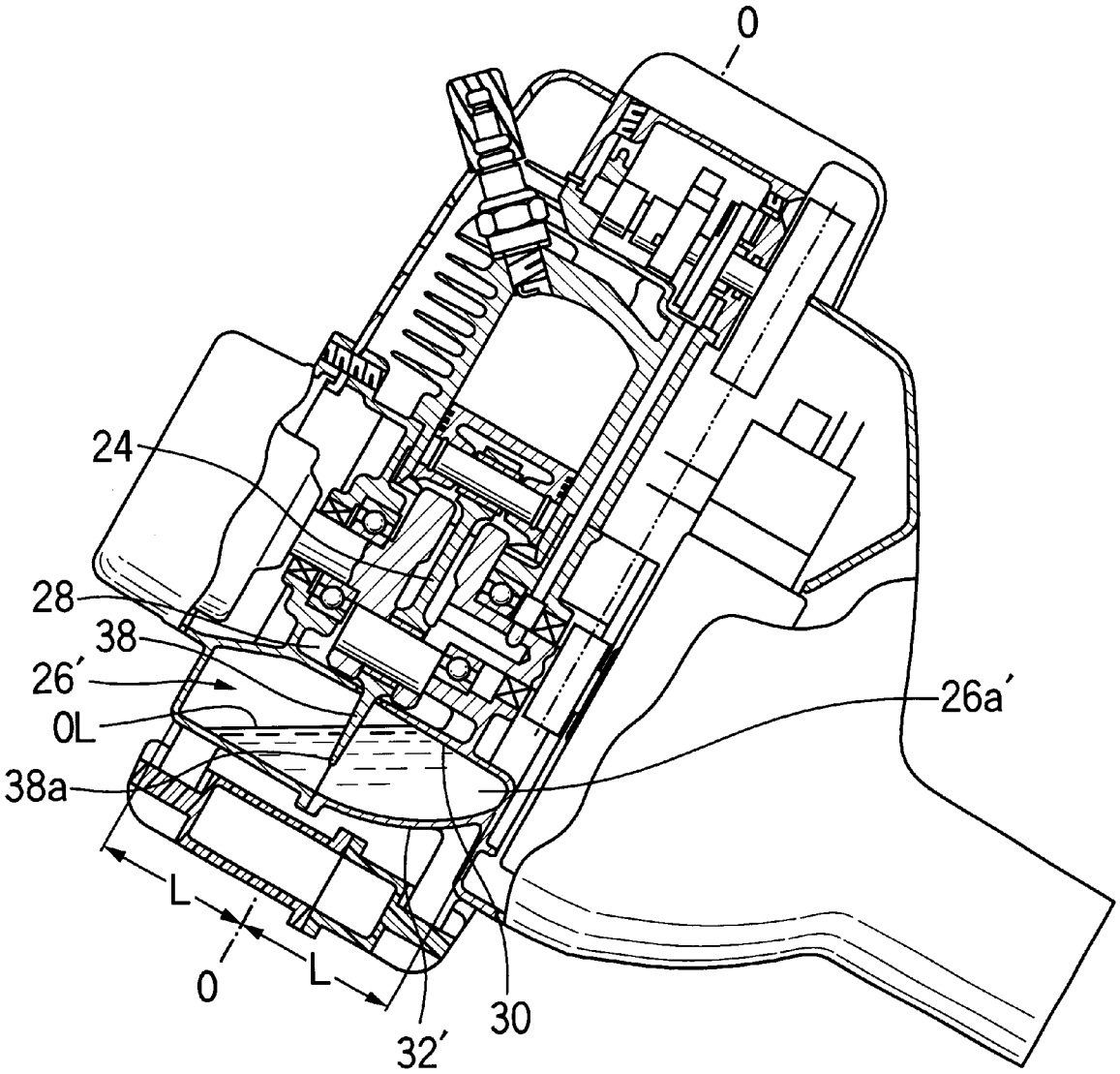
FIG. 6 is a cross-sectional view similar to those of FIGS. 2 to 4, illustrating a forwardly tilted position in accordance with a second embodiment of the present invention.
Figure 7:
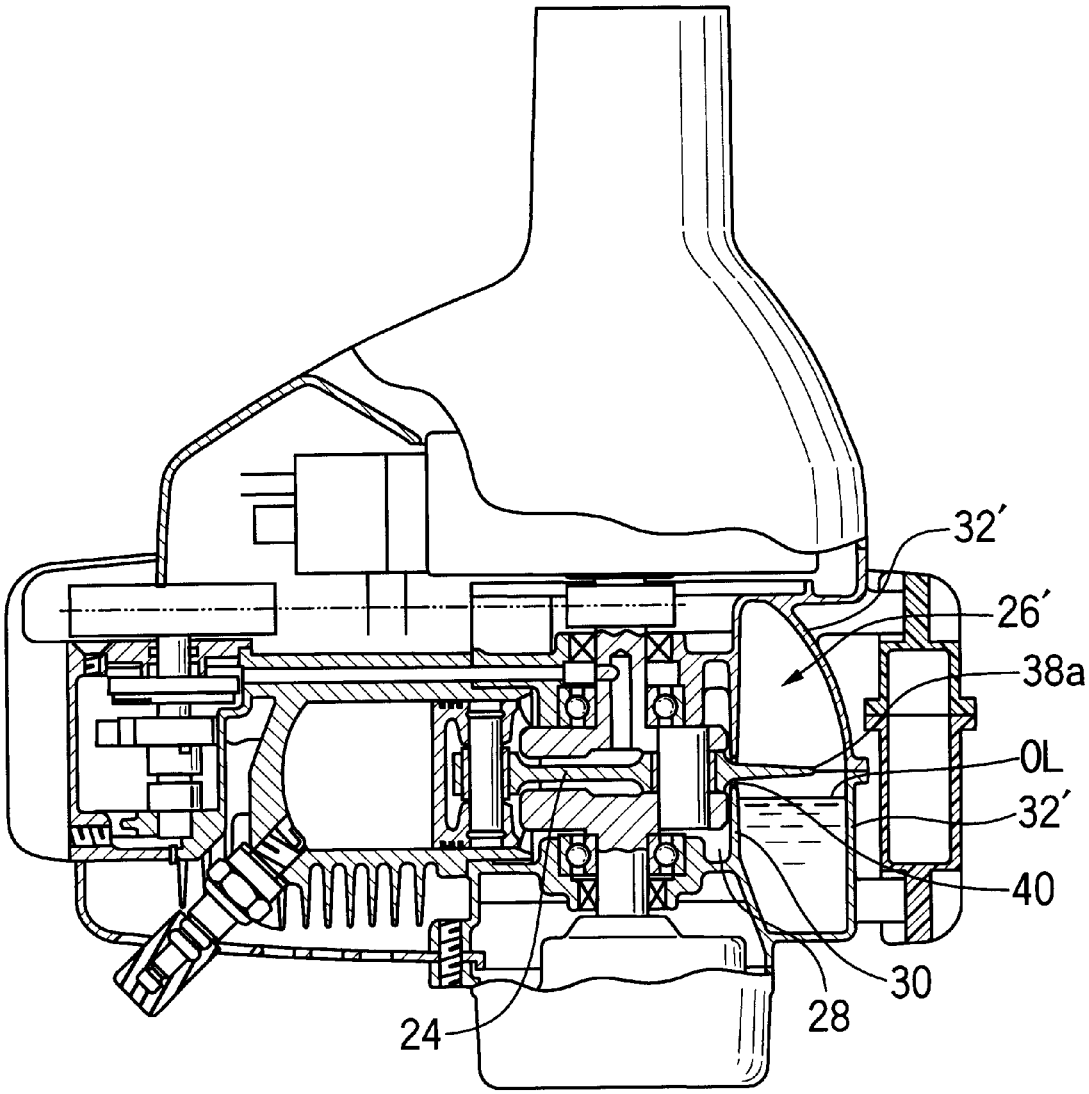
FIG. 7 is a cross-sectional view similar to those of FIGS. 2 to 4, illustrating an upwardly directed position in accordance with the second embodiment of the present invention.

The second embodiment shown in FIGS. 6 and 7 differs from the first embodiment shown in FIGS. 2 to 4 in that a rear portion of an oil reservoir 26' with respect to the center line O—O of the connecting rod 24 is formed into a rectangular or box shape in a section thereof. Since a front portion of the oil reservoir 26' is configured to be the same as that of the first embodiment shown in FIGS. 2 to 4, the description thereof will be omitted. If this type of configuration is employed, the same operational effect as that of the first embodiment described with reference to FIG. 3 can be obtained in the forwardly tilted position which occurs when the operator uses the cutting blade 8*a* to cut weeds or the like located at a height less than the operator's waist. Since, usually in the trimming operation, a percentage of time consuming for cutting weeds or the like at a height less than the operator's waist is maximum while that consumed for cutting branches above the operator's head is minimum, it is reasonable to form only the front portion into a spherical shape.

On the other hand, since the rear portion of the oil reservoir 26' is formed into a rectangular or box shape, it has the same width W as that of the front portion but has a greater volume than that. That is, the rear portion has a volume capable of accommodating all oil accommodated in the oil reserving area 34, and therefore, for example, as shown in FIG. 7, the oil is prevented from flowing into the crankcase 28 through the slit 40 even if the operator keeps the portable trimmer 2 in an upright position with the cutting blade 8*a* directed upwardly.

Figure 8A:
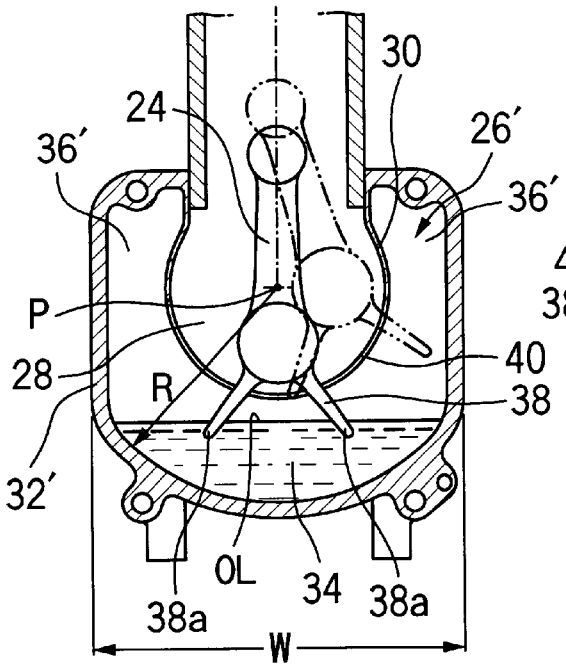
FIG. 8 is a vertical cross-sectional view corresponding to that of FIG. 5, illustrating a four-stroke cycle internal combustion engine in accordance with the second embodiment of the present invention shown in FIGS. 6 and 7.
Figure 8B:
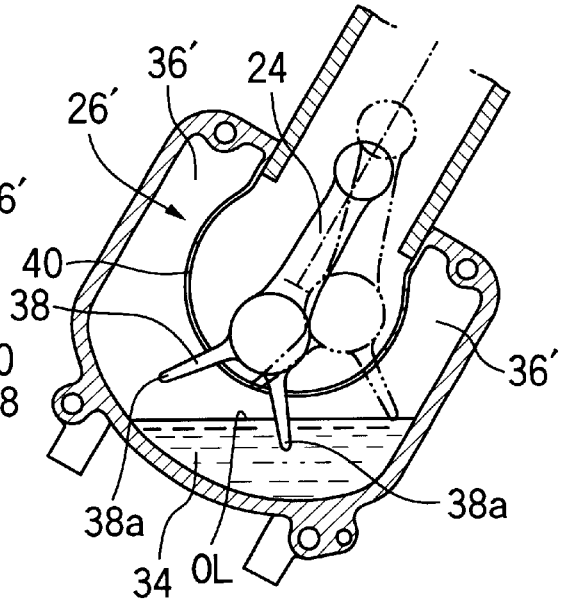
Figure 8C:
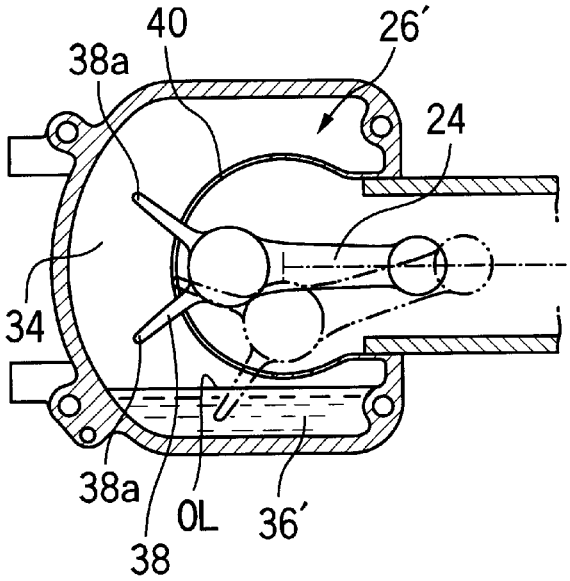

As can be seen in FIG. 8, the oil reservoir 26' of the second embodiment differs from that of the first embodiment in that, though an outer wall 32' in a portion thereof located below the crankcase 28 is formed into an arc shape defined by the center P and the radius R similar to that of the first embodiment, the outer wall 32' in a portion forming left and a right oil recess areas 36', 36' extends straight vertically. As shown in FIGS. 8*b* and 8*c*, each of the oil recess areas 36', 36' has enough volume to accommodate all oil so as to prevent the oil from flowing into the crankcase 28 through the slit 40. In the second embodiment, since the side portions of the outer wall 32' are straight, a distance (width) "w" between the outer walls 32', 32' is narrower than the distance (width) W between the outer walls 32, 32 of the first embodiment, so that the four-stroke cycle internal combustion engine can be made more compact.

Figure 9A:
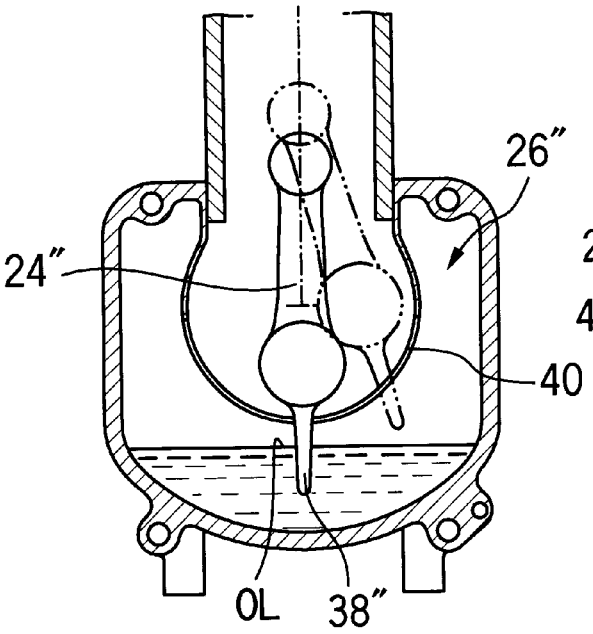
FIG. 9 is a vertical cross-sectional view on a plane intersecting with a crankshaft at right angle corresponding to that of FIGS. 5 and 8, illustrating a four-stroke cycle internal combustion engine in accordance with a third embodiment of the present invention.
Figure 9B:
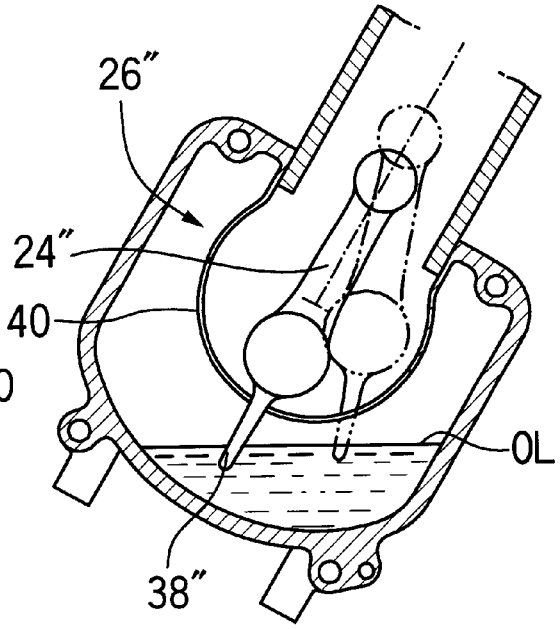
Figure 9C:
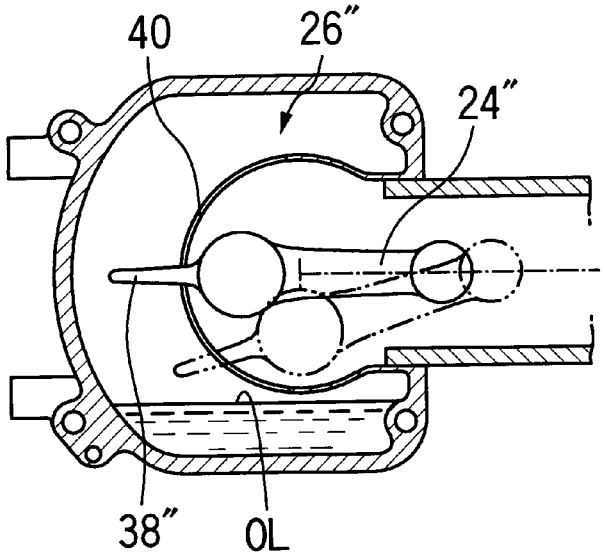

Though an oil reservoir 26" shown in FIG. 9 is configured similar to the oil reservoir 26' shown in FIG. 8, the third embodiment differs from the second embodiment in that a single oil dipper 38" is formed on a connecting rod 24" extending straight along a center line thereof. The oil dipper 38 of the first or the second embodiment may be configured in this form.

According to the first embodiment, even if the four-stroke cycle internal combustion engine 6 is in any of the cylinder-upright position, forwardly tilted position, backwardly tilted position, laterally tilted position or horizontal position, the height H of the oil level OL is kept approximately constant, so that the oil dipper 38 can always come into contact with the oil, effectively splash up the oil and certainly generate the oil mist, and whereby each part of the engine can be lubricated appropriately even if the operator uses the working machine under any of the positions described above for a long time.

Further, in the first embodiment, since the minimum distance S between the oil level OL and the partition wall 30 is kept approximately constant even in various tilted positions and each of the oil recess areas 36, 36 has enough volume to accommodate all of the oil, the oil is prevented from flowing into the crankcase 28 through the slit 40.

According to the second embodiment, the four-stroke cycle internal combustion engine 6 can be made relatively compact in its size, which allows the portable trimmer 2 to be designed compact in size as a whole.

Furthermore, in the first and the second embodiments, since there are provided two oil dippers 38, 38 extending toward each of the oil recess areas 36, 36 respectively, at least one of the oil dippers 38, 38 can come in contact with the oil and splash it up to produce the oil mist even if the four-stroke cycle internal combustion engine 6 is in the laterally tilted position.

The present invention has thus been shown and described with reference to specific embodiments. However, it should be noted that the present invention is in no way limited to the details of the described arrangement but changes and modifications may be made without departing from the scope of the appended claims.

For example, a sectional form of the oil reservoir 26 of the four-stroke cycle internal combustion engine 6 in accordance with the first embodiment shown in FIG. 5 can be modified into that shown in FIG. 8. Even if such modification is employed, an operational effect described with reference to FIGS. 2 to 4 can be obtained and that described with reference to FIG. 8 can also be obtained. On the other hand, a sectional form of the four-stroke cycle internal combustion engine in accordance with the second embodiment shown in FIG. 8 can be modified into that shown in FIG. 5. Even if such modification is employed, an operational effect described with reference to FIGS. 6 and 7 can be obtained and that described with reference to FIG. 5 can also be obtained. Further, sectional forms of the four-stroke cycle internal combustion engine in accordance with the first and the second embodiments shown in FIGS. 5 and 8 respectively can be modified into that shown in FIG. 9. Even if such modification is employed, operational effects described with reference to FIGS. 2 to 4 and FIGS. 6 and 7 can be obtained.

Though the outer wall 32 of the oil reservoir 26 shown in FIGS. 2 to 4 and the front portion of the outer wall 32' of the oil reservoir 26' shown in FIGS. 6 and 7 are formed into substantially a spherical shape, they need not necessarily be spherical. In the outer edge areas 26*a*, 26*b*, 26*a*' which are distant from the center line O—O of the oil dipper 38, the outer walls 32, 32' may be formed, for example, by a flat surface inclined toward the oil dipper 38 or by a curved surface. In that case, the outer walls 32, 32' are not necessarily required to be generally or gradually inclined or curved in a range between a portion just below the oil dipper 38 and the outer edge area 26*a*, 26*b* or 26*a*', but are merely required to be inclined or curved at least in the outer edge areas 26*a*, 26*b*, 26*a*'.

In the front portions 26*a*, 26*a*' of the oil reservoir 26 shown in FIGS. 2 to 4 and of the oil reservoir 26' shown in FIGS. 6 and 7, the outer walls 32, 32' are curved upwardly so as to surround the oil dipper 38. However, to keep the height H of the oil level OL approximately constant, the only requirement is that the outer edge areas 26*a*, 26*b*, 26*a*' of the oil reservoir 26, 26' are made narrower or flat. Therefore, instead of the curved outer walls, the outer edge area of the partition wall 30, for example, may be inclined downwardly in the direction to get near the outer wall 30.

Further, though the partition wall 30 is formed into a semi-cylindrical shape in each embodiment, the partition wall 30 may be formed into other shapes if the outer walls 32, 32' are formed into a spherical, arc-shaped or inclined surface.

Still further, though each of the oil dippers 38, 38' extends straight from the connecting rod 24 in the first, the second and the third embodiments, it may be formed into other shapes, for example, it may be curved toward oil recess area 36 or 36' in order to be certainly brought into contact with the oil.

Furthermore, though two oil dippers 38, 38 are provided in the first and the second embodiments, three or more oil dippers 38 may be provided for the purpose of certainly producing the oil mist, if necessary.

What is claimed is:

1. A four-stroke cycle internal combustion engine comprising:

a connecting rod having a big end;

an oil dipper provided at said big-end of said connecting rod;

a crank shaft;

a crankcase in which said crank shaft is disposed;

an oil reservoir below said crankcase, said oil reservoir having an oil level;

an outer wall which is outward of and surrounds said partition wall and is connected to said partition wall at upper ends thereof so as to define said oil reservoir below said crankcase, said outer wall having a portion located opposite to said partition wall; and a slit formed in said partition wall below said connecting rod to allow said oil dipper to protrude into and be withdrawn from said oil reservoir to splash oil in said oil reservoir for lubrication by said oil dipper through a swinging motion of said connecting rod;

wherein in a vertical cross-section including an axial line of said crankshaft, an outer edge area of said portion of said outer wall is upwardly inclined toward said oil dipper so that said oil reservoir has a depth that is shallower at least in said outer edge area thereof than that below said oil dipper, whereby a tip of said oil dipper reaches the oil level to said oil reservoir even when the oil flows into said outer edge area of said oil reservoir.

2. A four-stroke cycle internal combustion engine in accordance with claim 1, wherein, in the vertical cross-section including the axial line of said crankshaft, said portion of said outer wall is curved upwardly toward said oil dipper.

3. A four-stroke cycle internal combustion engine in accordance with claim 1, wherein said portion of said outer wall below said oil dipper is formed in a hemispheric shape so as to surround said oil dipper.

4. A four-stroke cycle internal combustion engine in accordance with claim 1, wherein said connecting rod has left, right, and lower sides, and wherein said partition wall surrounds said left and right sides of said connecting rod and said lower side thereof to define said crankcase, said outer wall surrounds said partition wall and is connected to said partition wall at upper ends thereof to define an oil reserving area below said crankcase and oil recess areas in each side of said crankcase, and said connecting rod has two oil dippers extending toward each of said oil recess areas, respectively.

5. A four-stroke cycle internal combustion engine in accordance with claim 1, wherein in the vertical cross-section including the axial line of said crankshaft, a first portion of said oil reservoir located on one side with respect to a center line of said connecting rod is formed into a rectangular shape and said outer edge area of a second portion of said oil reservoir located on the other side therewith is upwardly inclined toward said oil dipper.

* * * * *